United States Patent [19]

Manservisi et al.

[11] Patent Number: 4,607,475

[45] Date of Patent: Aug. 26, 1986

[54] DEVICE FOR FORMING GROUPS OF CIGARETTES IN PACKAGING MACHINES

[75] Inventors: Renato Manservisi, Bologna; Bruno Bagnaresi, Imola, both of Italy

[73] Assignee: SASIB S.p.A., Bologna, Italy

[21] Appl. No.: 678,213

[22] Filed: Dec. 4, 1984

[30] Foreign Application Priority Data

Dec. 20, 1983 [IT] Italy ..... 12701 A/83

[51] Int. Cl.[4] ..... B65B 19/04

[52] U.S. Cl. ..... 53/150; 53/148

[58] Field of Search ..... 53/148, 149, 150, 236, 53/247; 221/251, 260, 268, 276

[56] References Cited

U.S. PATENT DOCUMENTS

| | | | |
|---|---|---|---|
| 2,211,349 | 8/1940 | Nye | 221/260 |
| 2,551,199 | 5/1951 | Basus . | |
| 2,935,226 | 5/1960 | Hanson . | |
| 3,498,022 | 3/1970 | Godet | 221/171 |
| 3,790,025 | 2/1974 | Brodbeck | 221/200 |
| 3,833,148 | 9/1974 | Honas | 221/260 |
| 3,834,583 | 9/1974 | Brodbeck | 221/251 |
| 3,993,217 | 11/1976 | Davies | 221/93 |
| 4,096,682 | 6/1978 | Sheahan | 53/149 |
| 4,306,648 | 12/1981 | Manservisi et al. | 53/149 |
| 4,342,321 | 8/1982 | Zullo | 53/149 |
| 4,362,235 | 12/1982 | Erdmann | 53/149 |

FOREIGN PATENT DOCUMENTS

| | | | |
|---|---|---|---|
| 372201 | 5/1932 | United Kingdom | 53/148 |
| 2121393 | 12/1983 | United Kingdom . | |

*Primary Examiner*—John Sipos
*Assistant Examiner*—Donald R. Studebaker
*Attorney, Agent, or Firm*—Spencer & Frank

[57] ABSTRACT

The device for the formation of orderly groups of cigarettes in cigarette-packaging machines, in which each group of cigarettes is formed in a collecting container (6) which passes intermittently through two or more successive feeding stations (1,2,3) and receives in each of them a layer of cigarettes (S1,S2,S3) formed below the bottom outlets of corresponding substantially vertical feeding channels (C1,C2,C3), comprises interceptors (11) which are provided at the feeding stations to prevent the cigarettes (S) from exiting out of the bottom outlets of the feeding channels (C1,C2,C3). The interceptors (11) are actuated sequentially in the direction (F) of advance of the collecting containers (6), so as to be moved sequentially, when starting the packaging machine, upon the passage of the first container to be filled, from an active position in which they prevent the cigarettes from exiting out of the feeding channels (C1,C2,C3), to a rest position in which they permit the outflow of cigarettes from the feeding channels, while on completion of the operative period of the packaging machine or in case of a programmed inactivation thereof, they are moved after each other, upon the passage of the last container to be filled, from the rest position to the active position.

9 Claims, 4 Drawing Figures

DEVICE FOR FORMING GROUPS OF CIGARETTES IN PACKAGING MACHINES

BACKGROUND AND SUMMARY OF THE INVENTION

This invention relates to machines for packaging cigarettes or the like articles, and particularly to the device which, in these machines, is designed to form orderly groups of cigarettes, said groups consisting of "n" superimposed layers of cigarettes and being formed each in a collecting container which is passed intermittently through a series of "n" feeding stations wherein each container receives a layer of cigarettes during its dwell period, each station comprising a plurality of mutually adjacent and substantially vertical cigarette-feeding channels in which the cigarettes descend horizontally superimposed to each other and in single columns to form, below the bottom outlets of the feeding channels, a layer of cigarettes which is expelled in the axial direction of the cigarettes to be transferred into an opposite collecting container.

Generally, the individual layers of cigarettes are introduced into the collecting container at different levels in the successive feeding stations. Moreover, the individual layers of cigarettes are introduced, preferably simultaneously, into a group of "n" successive collecting containers present at the "n" feeding stations. The spacing between the successive containers may be the same as the spacing between the feeding stations, or it may be a sub-multiple and particularly one half of said spacing. The collecting containers may be supported either by an endless conveyor, e.g. a belt conveyor or a chain conveyor, or (in angularly equally-spaced positions) by a rotatable drum.

A disadvantage of the cigarette-packaging machines utilizing devices of the type specified above is that, upon starting the machine, before reaching a steady running condition, incomplete groups of cigarettes are formed and must be discarded by expelling them from the respective collecting containers, for example, by means of jets of compressed air. In fact, for example, in case of a packaging machine with three feeding stations for the formation of respective layers of 7, 6 and 7 cigarettes and with a spacing between the collecting containers which is equal to one half of the spacing between the stations, upon staring the machine and before obtaining a continuous succession of containers with complete groups of cigarettes, two collecting containers with only the bottom layer of 7 cigarettes and two successive collecting containers with only the bottom layer of 7 cigarettes and intermediate layer of 6 cigarettes will be obtained.

The heretofore known packaging machines comprising devices of the type described above and utilizing a hot quick-drying glue have the additional disadvantages to require a number of complete groups of cigarettes to be discarded before the machine reaches a pre-established minimum speed. In fact, at any speed lower than that, the wrapping sheets provided with glue and intended to enwrap the orderly groups of cigarettes cannot be fed because the glue would have dried when they reach the corresponding groups of cigarettes.

Another disadvantage of the known devices forming orderly groups of cigarettes in the packaging machines resides in the fact that when the work-shift of a packaging machine is over, or in case of a programmed inactivation thereof, incomplete groups of cigarettes are left in the collecting containers between the extreme feeding stations, and they must be removed. Complete groups of cigarettes to be removed are also left within collecting containers downstream of the feeding stations if a hot quick-drying glue is used.

These disadvantages are overcome by the present invention which, at each feeding station, provides an interceptor which is movable between an active position wherein it prevents the cigarettes from exiting out of the bottom outlets of the respective feeding channels, and a rest position wherein it permits the cigarettes to exit from the outlets of the feeding channels, means being provided to control the interceptors of the successive feeding stations sequentially in the direction of advance of the collecting containers, beginning from the first feeding station, whereby upon starting the packaging machine, after moving the interceptor of the first feeding station from its active position to its rest position and transferring the first cigarette layer into a first collecting container, to be filled completely, the interceptor(s) of the successive feeding station(s) will be moved sequentially from the active position to the rest position thereof only when said container reaches or is about to reach the respective feeding station to receive the corresponding cigarette layer, whereas when a work-shift is over or in case of a programmed inactivation of the packaging machine, the interceptors of the individual feeding stations are moved sequentially from their rest position to their active position, each after or simultaneously with the transfer of the respective layer of cigarettes into a last collecting container to be filled completely.

If a hot quick-drying glue is used, the cycle of movements of the interceptors from their active position to their rest position is started only when the packaging machine reaches the minimum permitted production speed.

It is apparent from the above that, by virtue of the device according to the invention, in case of a programmed inactivation of a packaging machine or at the end of its work-shift, a condition will be obtained wherein a succession of collecting containers are all provided with complete groups of cigarettes and no trailing collecting container will be left with incomplete groups of cigarettes. Since, in case of inactivation of the packaging machine, all the complete groups of cigarettes will be packaged, all the collecting containers will be left completely empty, thus facilitating the normal maintenance operations. Even upon staring the packaging machine (which occurs with completely empty collecting containers) the formation of incomplete groups of cigarettes, to be discarded and expelled from the collecting containers, is avoided because the outflow of the cigarette layers from the bottom outlets of the feeding channels in the feeding stations following the first station is permitted only when a collecting container already supplied with a cigarette layer in the first feeding station reaches the successive feeding station(s) to receive the respective cigarette layer(s). If a hot quick-drying glue is used, upon starting the packaging machine, the formation of complete groups of cigarettes to be discarded before the packaging machine reaches the minimum speed required for a correct operation is avoided, because the outflow of cigarette layers from the bottom outlets of the feeding channels at the feeding stations is permitted only when the packaging machine has reached the required minimum speed.

The invention may be carried out in various ways. Specifically, either the interceptors associated with the feeding channels in the individual feeding stations, and the control means for said interceptors may be embodied in any suitable manner.

In a preferred embodiment of the invention, the interceptor associated with each feeding station is formed by a thin diaphragm which is inserted, in its active position, under the bottom outlets of the respective feeding station, between these outlets and the path of travel of the reciprocatory pusher which transfers the cigarette layer formed under the outlets of said feeding channels into the collecting container.

According to a further advantageous feature of the invention, said intercepting diaphragm is of flexible nature and is secured at one end to a winding roller on which it is wound when at rest, while it is unwound and horizontally slidably guided under the bottom outlets of the feeding channels when it is activated. This embodiment has the advantageous characteristics of a reduced size and an easy control of the winding roller, e.g. by means of an associated electric motor of the step-by-step type.

BRIEF DESCRIPTION OF THE DRAWINGS

These and other characteristics of the invention and the advantages resulting therefrom will be apparent from the following description of a preferred embodiment thereof, shown by way of example in the accompanying drawings, in which.

DESCRIPTION OF A PREFERRED EMBODIMENT

Figure 1:
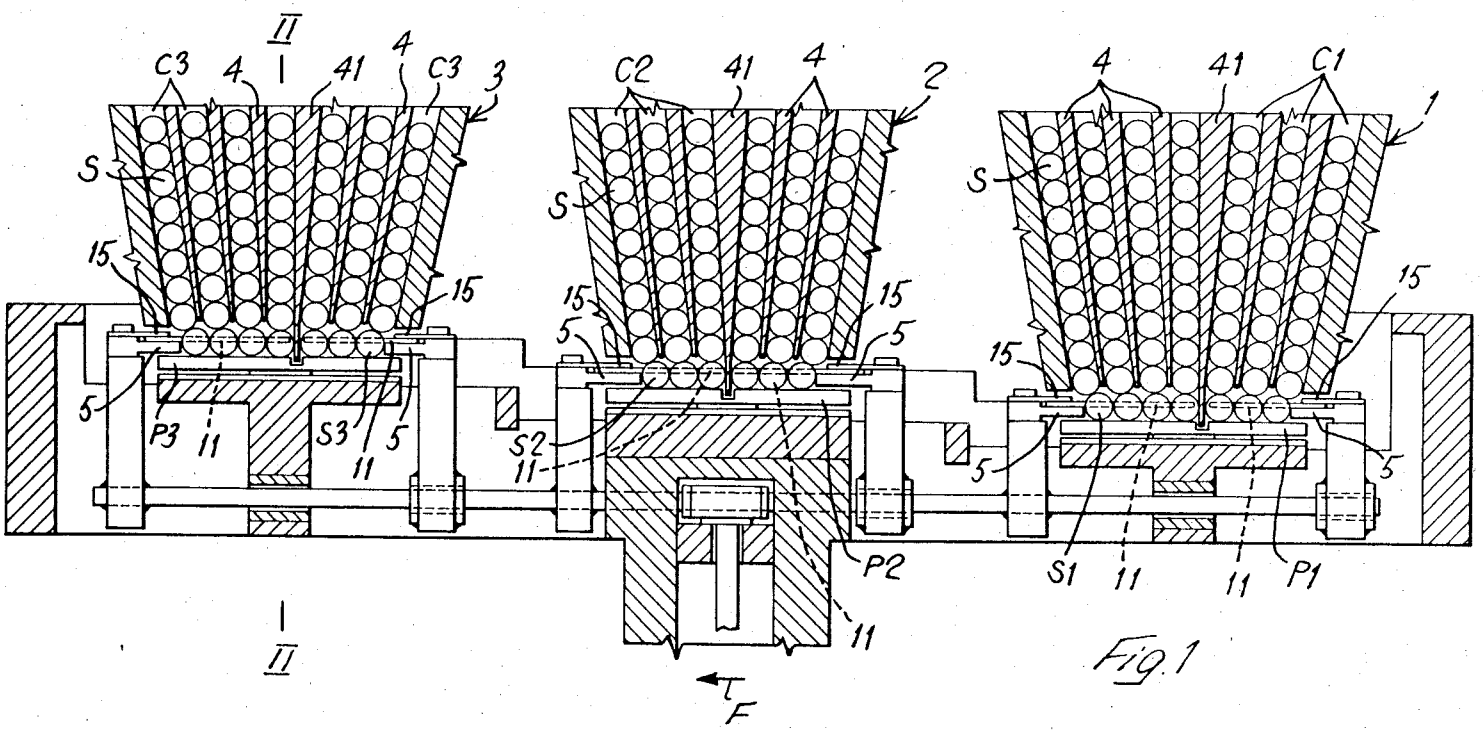
FIG. 1 is a vertical sectional view of the lower portion of the feeding hopper of a cigarette-packaging machine.

With reference to the drawings, the lower portion of the feeding hopper of a cigarette-packaging machine comprises three groups of feeding channels C1, C2 and C3, each forming a feeding station 1, 2 and 3. The individual feeding channels C1, C2, C3 of each feeding station are substantially vertical and are separated from each other by partitions 4, 41. Under the bottom outlets of the feeding channels C1, C2 and C3, at a distance just greater than the diameter of a cigarette S, each feeding station 1, 2, 3 comprises a substantially horizontal cigarette-supporting table P1, P2 and P3 whereon a cigarette layer is formed by the cigarette discharged from the bottom outlets of the respective feeding channels C1, C2, C3.

Each of the stations 1 and 3 comprises seven feeding channels C1 and C3, arranged side by side, so that the horizontally-arranged cigarettes S descending through these channels will form, on the respective cigarette-supporting table P1, P3 therebelow, layers S1, S3 constituted each by seven cigarettes S. The intermediate station 2, however, comprises six feeding channels C2, arranged side by side, so that a layer S2 constituted by six cigarettes S will be formed on the cigarette-supporting table P2. The cigarette-supporting tables P1, P2, P3 of the three feeding stations 1, 2, 3 are located at three different levels, respectively, i.e. the cigarette-supporting table P2 of the station 2 is at a level substantially one-cigarette-diameter higher than the level of the cigarette-supporting table P1 of the station 1, while the level of the cigarette-supporting table P3 of the station 3 is at a level substantially one-cigarette-diameter higher than the level of the cigarette-supporting table P2 of the station 2. The bottom outlets of the groups of feeding channels C1, C2, C3 associated with the three stations 1, 2, 3 are at three different levels, similarly to the above, because the distance between the bottom outlets of the three groups of feeding channels C1, C2, C3 and the respective cigarette-supporting tables P1, P2, P3 therebelow are identical to each other in the three feeding stations 1, 2 and 3.

The partitions 4 between the individual feeding channels C1, C2, C3 in the individual stations 1, 2, 3 terminate at the bottom thereof at the level of the outlets of the respective channels, i.e. at the corresponding level above the respective cigarette-supporting table P1, P2, P3, with the exception of an intermediate partition 41 the lower end of which extends further to engage into a corresponding groove in the respective cigarette-supporting table P1, P2, P3. This longer partition 41 is intended to avoid any damage to the cigarettes forming the layer S1, S2, S3 on the cigarette-supporting table P1, P2, P3 when said cigarette layer S1, S2, S3 is clamped between the respective side approachers 5 which are intended to move the cigarettes of the just-formed layer S1, S2, S3 into contact with each other, thus eliminating the gaps therebetween due to the thickness of the partitions 4, 41.

Suitable collecting containers 6 mounted on an endless conveyor 7, e.g. of the chain type, are passed through the successive feeding stations 1, 2, 3 opposite the front end of the respective cigarette-supporting tables P1, P2, P3. An orderly group of cigarettes to be packaged which is formed, in the illustrated example, by twenty cigarettes orderly arranged in three superimposed layers of 7-6-7 cigarettes, must be formed in each of said collecting containers 6. Each collecting container 6 is of tubular substantially prismatic shape, and at least the top and bottom walls thereof converge slightly toward one of the two open ends of said container 6. The collecting containers 6 are directed with the larger end thereof towards the feeding stations 1, 2, 3 and the mouth of said end is provided at its interior with two cigarette-guiding partitions 8, 108 which will be located between the three superimposed layers of cigarettes S1, S2, S3 accommodated in said collecting container 6. The collecting containers 6 are moved at the feeding stations 1, 2, 3 in the direction of the arrow F in FIG. 1 and are moved at such a level whereby their three superimposed recesses defined by the two cigarette-guiding partitions 8, 108 and intended to receive each a cigarette layer S1, S2, S3, will present themselves—after each other and beginning from the lowest recess—in front of the cigarette-supporting table P1, P2, P3 of the successive feeding stations 1, 2, 3. The movement of the series of collecting containers 6 is intermittent, so that each container 6 will dwell a certain time at each feeding station 1, 2, 3.

Specifically, when a collecting container 6 is in the first feeding station 1, the bottom of said container 6 is substantially at the same level as the cigarette-supporting table P1 and the layer of seven cigarettes S1 formed on said table P1 is transferred, during the dwell of the container 6 and by means of a reciprocatory pusher 9 mounted on a support member 10, in the longitudinal direction of the cigarettes S1 from said table P1 into the lowest recess of the collecting container 6 between the bottom and the lower cigarette-guiding partition 8 of said container. Thereafter, when said collecting container 6 will stop at the second feeding station 2, its cigarette-guiding partition 8 will be at the level of the cigarette-supporting table P2 and the respective reciprocatory pusher 9 will transfer the cigarette layer S2 formed on said table P2 from this latter into the intermediate recess of the collecting container 6 between the two cigarette-guiding partitions 8, 108. Finally, when said collecting container 6 will stop at the third feeding station 3, as viewed in FIG. 2, the upper cigarette-guiding partition 108 of the container 6 will be at the level of the respective cigarette-supporting table P3 and the cigarette layer S3 will be transferred by the associated reciprocatory pusher 9 from said table P3 into the upper recess of the collecting container 6 on the upper cigarette-guiding partition 108 thereof, as viewed in FIG. 3. By this arrangement, the orderly group of 7-6-7 cigarettes, formed by the three superimposed layers of cigarettes S1, S2, S3 will be formed in each collecting container 6.

At each feeding station 1, 2, 3 the invention provides an intercepting diaphragm 11 adapted to prevent the cigarettes S from exiting from the bottom outlets of the respective feeding channels C1, C2, C3. Said diaphragm 11 is formed of a thin and flexible material and is secured at one end thereof at 111 to a winding roller 12 arranged in the rear portion of the respective feeding station 1, 2, 3 on the opposite side with respect to the collecting containers 6. The winding roller 12 is accommodated in a stationary casing 13 provided with a slot 113 wherethrough the free end of the flexible diaphragm 11 is passed outwards. On exiting from said casing 13, the flexible diaphragm 11 is passed between two straight guides 14 and then between an overlying direction-changing roller 16 and the underlying reciprocatory pusher 9. The flexible diaphragm 11 is supported laterally by means of side guides formed between the upper surface of the approachers 5 and overlying guide plates 15 just below the bottom outlet of the feeding channels C1, C2, C3 of the respective feeding station 1, 2, 3.

Figure 4:
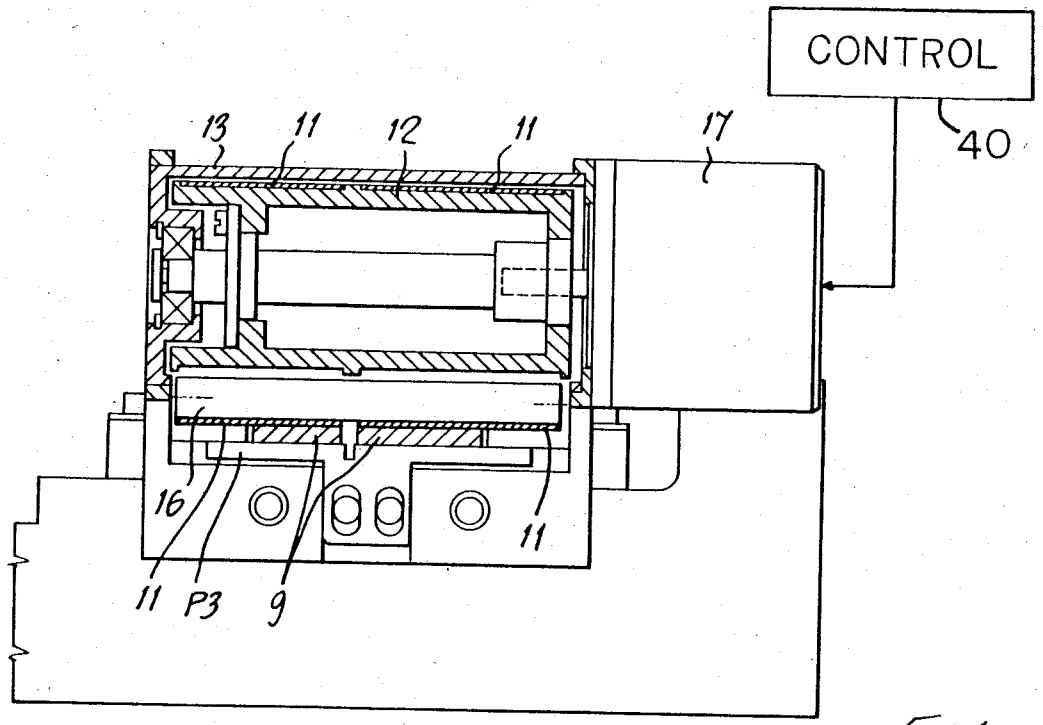
FIG. 4 is a sectional view on the line IV—IV of FIG. 3.

In the illustrated embodiment, each flexible intercepting diaphragm 11 is formed by two parallel side by side portions closely spaced from each other which are passed at the opposite sides of the extended partition 41 of the respective group of feeding channels C1, C2, C3 as seen particularly in the FIGS. 1 and 4. Of course, all the partitions 4, 41 of the group of feeding channels C1, C2, C3 may terminate at the same level, flush of the bottom outlets of the feeding channels C1, C2 and C3, i.e. they may be all spaced from the underlying cigarette-supporting table P1, P2 and P3, and then the respective flexible intercepting diaphragm 11 will be formed by a single piece.

Figure 2:
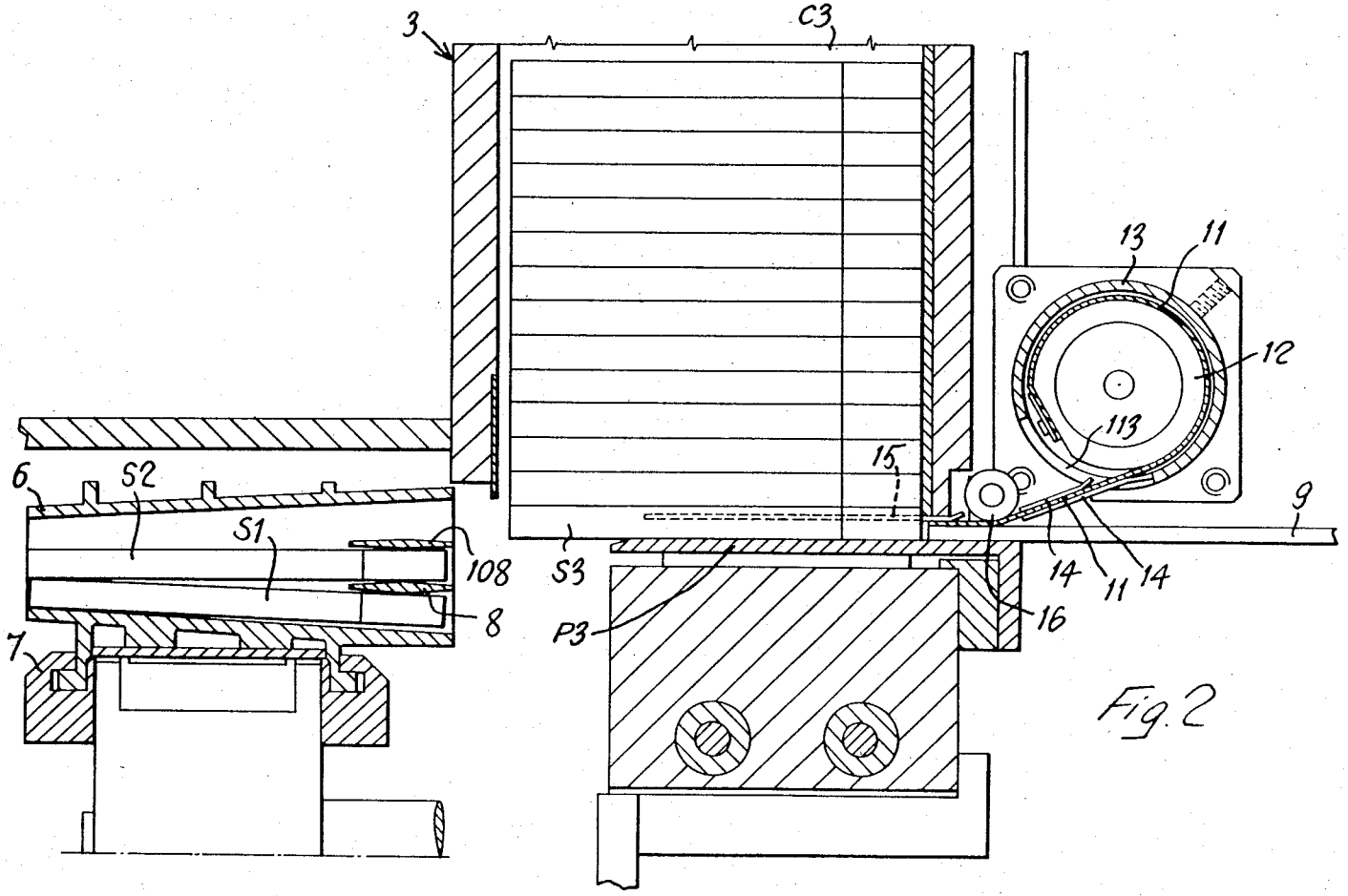
FIGS. 2 and 3 are sectional views, on the line II—II of FIG. 1, showing two different operative steps.

The winding roller 12 of each flexible intercepting diaphragm 11 is actuated by an associated small electric motor 17, of the step-by-step type, by means of which the flexible intercepting diaphragm 11 is wound on the roller 12 and is unwound therefrom, to be moved respectively to a rest position or to an active position. In the rest position, the flexible intercepting diaphragm 11 is wound almost entirely on the winding roller 12 and its free end—which is substantially flush with the front end of the respective reciprocatory pusher 9—is engaged in the rear mouth of the side guides formed between the plates 15 and the approachers 5, as shown in FIG. 2. On the other hand, in the active position, the flexible intercepting diaphragm 11 is unwound from the winding roller 12 and extends substantially to the front side of the respective group of feeding channels C1, C2 and C3, thus closing their bottom mouths, as shown in FIG. 3.

Figure 3:
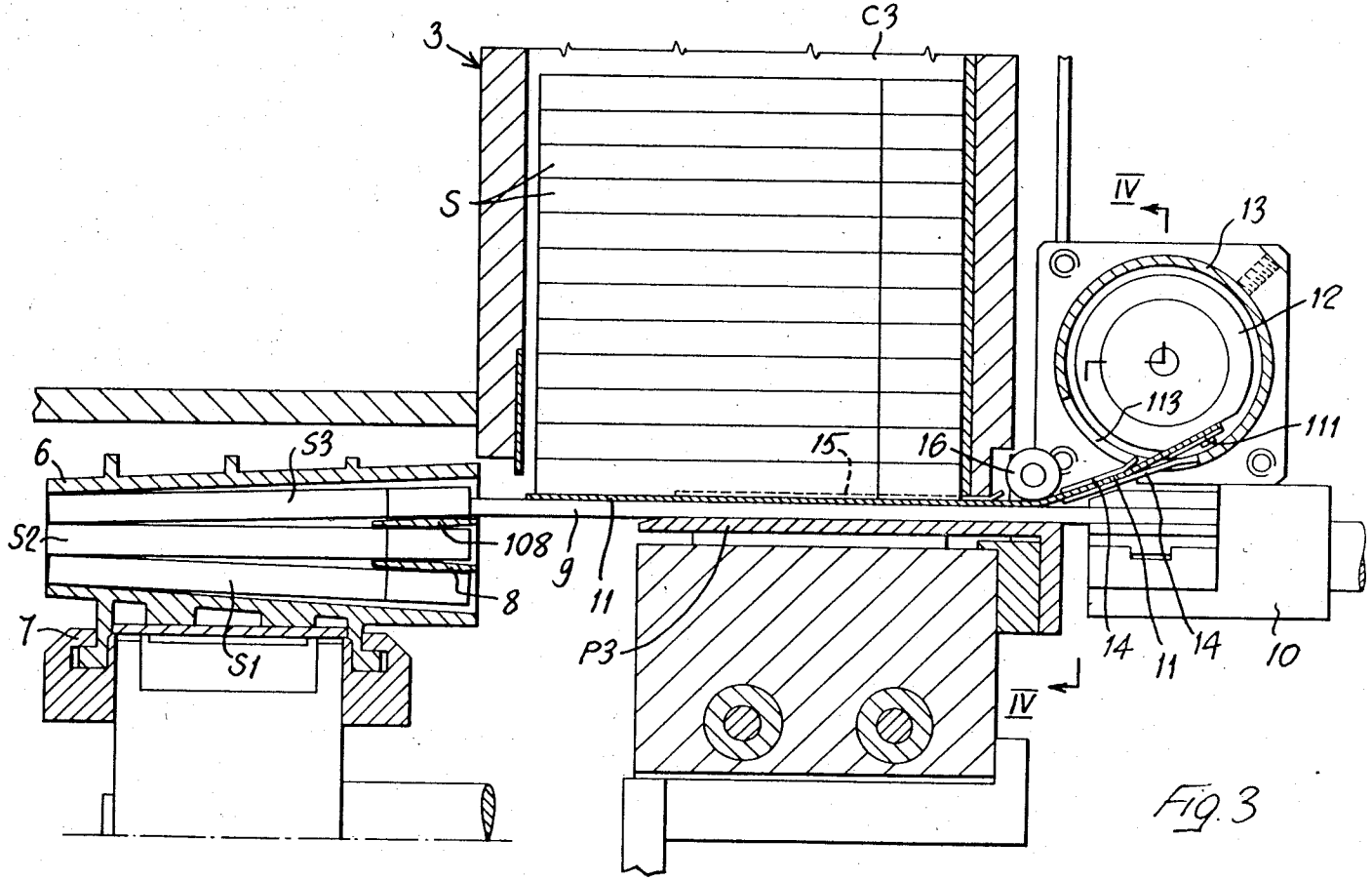

Preferably, each flexible intercepting diaphragm is moved from its rest position shown in FIG. 2 to its active position shown in FIG. 3 simultaneously with the advancing movement of the respective pusher 9 upon transferring a cigarette layer S1, S2, S3 from the cigarette-supporting table P1, P2, P3 into the opposite collecting container 6 that dwells at that time in front of said table P1, P2, P3. The electric motor 17, therefore, controls said movement of the flexible diaphragm 11 from the wound up rest position to the unwound active position, according to a rate of movement which is substantially the same as the rate of advance of the corresponding pusher 9, or according to a rate of movement which is just lower than the rate of advance of the pusher 9, so as to avoid that the free end of the flexible intercepting diaphragm will protrude forwards with respect to the front end of the pusher 9 and exerts an undesired pusher action against the cigarette layer S1, S2, S3 to be transferred into the collecting container 6, since the thickness of the pusher 9 is smaller than the diameter of the cigarettes S. The return movement of the flexible intercepting diaphragm 11 from its active unwound position of FIG. 3 to its rest wound up position of FIG. 2 may also occur simultaneously with the corresponding retraction movement of the pusher 9, or independently therefrom.

Before starting the packaging machine, the flexible intercepting diaphragms 11 of all the feeding stations 1, 2, 3 are in their active position shown in FIG. 3, thus closing the bottom outlets of the respective feeding channels C1, C2, C3 and supporting the ranges of cigarettes S thereabove. The underlying cigarette-supporting tables P1, P2, P3 are now unoccupied. Upon starting the packaging machine, only the intercepting diaphragm 11 of the first feeding station (with respect to the feeding direction F of the collecting containers 6) is, first, retracted into its rest position, e.g. just before an empty collecting container 6 stops at that station 1. Therefore, on the cigarette-supporting table P1 of said feeding station 1 there will be formed the respective cigarette layer S1 which will be transferred as described above into the collecting container 6 during the dwell period thereof at said station 1. The collecting containers preceding the one which has been loaded at the station 1 with the first layer of cigarettes S1 and now at the feeding stations 2 and 3, will receive no cigarette layer although the respective pushers 9 are advanced simultaneously with that of the station 1, because at said stations 2 and 3 the intercepting diaphragms 11 are in their active position and prevent the cigarettes from exiting from the bottom outlets of the respective feeding channels C2, C3 so as to keep the corresponding cigarette-supporting tables P2, P3 free of cigarettes. Only when the collecting container 6 which has received the first cigarette layer S1 at the first feeding station 1, reaches or is about to reach the feeding station 2, the intercepting diaphragm 11 associated with said station 2 is also moved to its rest position, so as to open the bottom outlets of the feeding channels C2 to permit the formation on the underlying cigarette-supporting table P2 of a cigarette layer S2 which is transferred as described above into said collecting container 6 during the dwell thereof at the station 2. The intercepting diaphragm 11 of the third feeding station 3 which was till now in its active position, is retracted into its rest position when the container 6 which has already collected the two cigarette layers S1 and S2 reaches or is about to reach said third station 3. Thus, the bottom outlets of the feeding channels C3 of the third station 3 are also opened, whereby on the cigarette-supporting table P3 thereof there will be formed the respective cigarette layer 3 which is transferred by the pusher 9 as described above into the collecting container 6 which has been already provided with the first two cigarette layers S1 and S2. The group of cigarettes S1, S2, S3 of this collecting container 6 is thus completed. Obviously, all the preceding containers 6 are completely empty, while all the following containers 6 are completely full.

If hot quick-drying glues are used, said sequential retraction cycle of the intercepting diaphragms 11 of the successive feeding stations 1, 2, 3 from their active position to their rest position, will begin only when the packaging machine reaches the minimum permitted production speed in order that the sheets of packaging material, provided with the glue, will reach the corresponding groups of cigarettes to be packaged before said glue has dried.

In case of a programmed inactivation of the packaging machine, or when its work-shift is over, firstly only the intercepting diaphragm 11 of the first feeding station 1 is moved from its rest position to its active position, preferably together with the respective pusher 9 and, therefore, simultaneously with the transfer of the first cigarette layer S1 into a collecting container 6. When this container 6 reaches the second feeding station 2, the respective intercepting diaphragm 11 is also moved to its active position, simultaneously with the transfer of the second cigarette layer S2, into said container 6. The next collecting container 6 present at the first feeding station 1, however, will receive no cigarette layer S1 although the respective pusher 9 performs its transfer movement, because the bottom outlets of the corresponding feeding channels C1 have already been closed by the intercepting diaphragm 11 and no more cigarette layer S1 has been formed on the underlying cigarette-supporting table P1. Similarly, when said container 6 which has already collected the first and the second cigarette layers S1 and S2 reaches the third feeding station 3 and receives the third cigarette layer S3, simultaneously with the transfer of said third layer S3 by means of the pusher 9, the corresponding intercepting diaphragm 11 is also moved to its active position, thus interrupting the outflow of cigarettes S from the bottom outlets of the respective feeding channels C3, as seen in FIG. 3. Therefore, said collecting container 6 receiving the last cigarette layer S3 from the third feeding station 3 is supplied with a complete group of cigarettes S1, S2, S3 similarly to all preceding collecting containers, whereas all the following collecting containers 6 will be completely empty. The complete groups of cigarettes formed in the collecting containers 6 will be all packaged before the packaging machine has stoped, whereby the latter will be completely devoid of cigarettes when stopped, thus facilitating the normal maintenance operations and avoiding the necessity to discard any cigarette.

The above successive movements of the intercepting diaphragms 11 either to close or to open the respective feeding channels C1, C2, C3 are obtained by means of corresponding actuations of the electric motors 17 with the aid of control 40, e.g. of electrical or electronic type, and in combination with suitable means and sensors for consent and synchronization with the movement of the collecting containers 6 and reciprocatory pushers 9.

The invention is not limited to the embodiment described above, and broad changes and modifications—especially of constructional nature—may be made thereto. In particular, the invention may be applied not only to the packaging machines in which the successive feeding stations have an in-line and substantially horizontal arrangement and/or the collecting containers are mounted on an endless flexible conveyor, such as a chain or a belt, but also to the packaging machines in which the collecting containers are carried by a rotatable drum and/or the successive feeding stations are arranged on an arc of the arcuated path of travel of the collecting containers. Moreover, the invention is not limited to the packaging machines for cigarettes, but it can be applied advantageously to packing or packaging machines for any other articles, particularly rod-like articles.

We claim:

1. A device for use with a cigarette packaging machine to form orderly groups of cigarettes, each group having a plurality of "n" layers, comprising:

a plurality of collecting containers;

means for moving the containers along a path in an advance direction, the movement of the containers being intermittent so that there are dwell periods in the advance thereof;

a series of "n" feeding station means adjacent the path for forming cigarette layers, each feeding station means including means defining a plurality of cigarette-feeding channels having bottom outlets for forming a cigarette layer below the bottom outlets, the feeding channels being mutually adjacent and substantially vertical, with cigarettes descending in single columns through respective channels, means for ejecting a layer of cigarettes beneath the bottom outlets to transfer the ejected layer into a container dwelling adjacent the respective feeding station means, the layer of cigarettes being ejected in the axial direction of the cigarettes, an interceptor that is movable between an active position in which the interceptor prevents cigarettes from exiting the bottom outlets of the feeding channels, and a rest position in which the interceptor permits cigarettes to flow from the bottom outlets of the feeding channels, and moving means for moving the interceptor between its active and rest positions, and control means for actuating the moving means of successive feeding station means sequentially during start-up of the cigarette packaging machine and during a scheduled shut-down thereof to avoid partially filled containers, for moving interceptors one after the other from their active positions to their rest positions during start-up as a predetermined initial container advances from one feeding station means to the next, and for moving the interceptors one after the other from their rest positions to their active positions during a scheduled shut-down as a predetermined final container advances from one feeding station means to the next.

2. A device according to claim 1, wherein the packaging machine employs wrapping sheets and hot quick-drying glues to wrap the orderly groups of cigarettes, and wherein the cycle of the successive movement of the interceptors from their active positions to their rest positions upon starting the packaging machine begins when the machine reaches the minimum permitted production speed.

3. A device for use with a cigarette packaging machine to form orderly groups of cigarettes, each group having a plurality of "n" layers, comprising:

a plurality of collecting containers;

means for moving the containers along a path in an advance direction, the movement of the containers being intermittent so that there are dwell periods in the advance thereof, and a series of "n" feeding station means adjacent the path for forming cigarette layers, each feeding station means including means defining a plurality of cigarette-feeding channels having bottom outlets for forming a cigarette layer below the bottom outlets, the feeding channels being mutually adjacent and substantially vertical, with cigarettes descending in single columns through respective channels, means for ejecting a layer of cigarettes beneath the bottom outlets to transfer the ejected layer into a container dwelling adjacent the respective feeding station means, the layer of cigarettes being ejected in the axial direction of the cigarettes, the means for ejecting comprising a pusher that transfers the cigarette layer formed under the outlets of said feeding channels into a collecting container, the pusher having a path of travel, an interceptor that is movable between an active position in which the interceptor prevents cigarettes from exiting the bottom outlets of the feeding channels, and a rest position in which the interceptor permits cigarettes to flow from the bottom outlets of the feeding channels, the interceptor comprising a thin diaphragm, and moving means for moving the interceptor between its active and rest positions, the moving means comprising means for inserting the diaphragm between the path of travel of the pusher and the bottom outlets of the feeding channels when the interceptor moves to its active position.

wherein the moving means of successive feeding station means are actuated sequentially during start-up of the cigarette packaging machine and during a scheduled shut-down thereof to avoid partially filled containers, with interceptors being moved one after the other from their active positions to their rest positions during start-up as a predetermined initial container advances from one feeding station means to the next, and with the interceptors being moved one after the other from their rest positions to their active positions during a scheduled shut-down as a predetermined final container advances from one feeding station means to the next.

4. A device according to claim 3, wherein the diaphragm is flexible and has an end, and wherein the moving means further comprises a winding roller to which the end of the diaphragm is secured, the diaphragm being wound up on the roller when in the rest position and being moved to the active position by being unwound therefrom in a horizontally and slidably guided manner to a position below the bottom outlets of the feeding channels.

5. A device according to claim 3, wherein said pusher has a feeding stroke, and wherein said diaphragm is movable in the same direction as the pusher for transferring the cigarette layer and it is moved from its rest position to its active position substantially simultaneously with the feeding stroke of said pusher when transferring the cigarette layer into the collecting container.

6. A device according to claim 4, wherein the moving means further comprises an electric motor to actuate the winding roller for the diaphragm.

7. A device according to claim 3, wherein the means for forming a cigarette layer further comprises a cigarette-supporting table on which the respective cigarette layer is formed, and a partition between the feeding channels in the intermediate portion of the respective group of feeding channels, the partition extending downwards beyond the outlets of said feeding channels down to the cigarette-supporting table, and wherein the diaphragm has two side-by-side closely spaced portions at the opposite sides of said partition.

8. A device according to claim 4, wherein the means for forming a cigarette layer further comprises approachers bounding the cigarette layer laterally, wherein the diaphragm has a free end, and wherein the means for moving further comprises side guides that are disposed lower than the bottom outlets of the feeding channels and that are formed between guide plates and the approachers, a rectilinear inclined guide which follows the winding roller, and a direction-changing roller that is disposed above the pusher, the diaphragm being guided by the inclined guide and passing between the direction-changing roller and the pusher, with its free end being directed into the side guides.

9. A device according to claim 6, wherein the motor is a step-by-step motor.

* * * * *